US005423170A

United States Patent [19]

Dammann et al.

[11] Patent Number: 5,423,170

[45] Date of Patent: Jun. 13, 1995

[54] SUCTION APPARATUS FOR WITHDRAWING ADVANCING YARNS TO A WASTE CONTAINER

[75] Inventors: Peter Dammann, Remscheid; Klaus Bartkowiak, Herne, both of Germany

[73] Assignee: Barmag Ag, Remscheid, Germany

[21] Appl. No.: 46,022

[22] Filed: Apr. 12, 1993

[30] Foreign Application Priority Data

Apr. 11, 1992 [DE] Germany ..... 42 12 241.4
Dec. 8, 1992 [DE] Germany ..... 42 41 291.9

[51] Int. Cl.[6] ..... D01H 9/14; D01H 9/00

[52] U.S. Cl. ..... 57/305; 15/301; 57/303; 242/18 AA; 242/18 PW

[58] Field of Search ..... 242/35.5 R, 18 AA, 18 PW, 242/18 A; 226/97; 15/301; 57/303, 304, 305

[56] References Cited

U.S. PATENT DOCUMENTS

| | | | |
|---|---|---|---|
| 2,780,908 | 2/1957 | Bechtler | 57/305 X |
| 2,890,563 | 6/1959 | Seress | 57/305 |
| 2,946,174 | 7/1960 | Bahnson | 242/18 AA |
| 2,976,556 | 3/1961 | Reiterer | 57/304 X |
| 3,381,462 | 5/1968 | Parker et al. | 57/305 |
| 3,391,528 | 7/1968 | Shackelford | 57/304 |
| 3,750,922 | 8/1973 | Bethea et al. | 226/97 |
| 3,902,761 | 9/1975 | Pradier | 302/1 |
| 3,974,972 | 8/1976 | Egli et al. | 242/18 PW |
| 4,022,006 | 5/1977 | Howorth | 57/34.5 |
| 4,322,040 | 3/1982 | Gadeix et al. | 242/18 PW |
| 4,825,634 | 5/1989 | Halder et al. | 57/305 |
| 5,070,688 | 12/1991 | Kato et al. | 57/304 |
| 5,107,668 | 4/1992 | Dammann | 57/305 X |
| 5,158,241 | 10/1992 | Dammann et al. | 242/18 PW |
| 5,284,010 | 2/1994 | Dammann | 57/305 X |
| 5,348,242 | 9/1994 | Bauer et al. | 242/18 EW |

FOREIGN PATENT DOCUMENTS 0404045 6/1990 European Pat. Off. .

*Primary Examiner*—Daniel P. Stodola
*Assistant Examiner*—William Stryjewski
*Attorney, Agent, or Firm*—Bell, Seltzer, Park & Gibson

[57] ABSTRACT

A yarn winding machine having a suction apparatus for withdrawing the severed advancing yarns during the bobbin changing operation. The suction apparatus comprises a tubular duct which extends the length of the winding machine, and the duct mounts a yarn intake tube of relatively small diameter in front of each of the side by side winding stations of the machine. A yarn is adapted to be sucked into and through each of the yarn intake tubes by the relatively high speed air current flowing therethrough, and the yarn then advances into the tubular duct and to a waste container.

12 Claims, 3 Drawing Sheets

SUCTION APPARATUS FOR WITHDRAWING ADVANCING YARNS TO A WASTE CONTAINER

BACKGROUND OF THE INVENTION

The present invention relates to a yarn winding machine having a plurality of side by side yarn winding stations, and more particularly, to a suction apparatus for withdrawing one or more of the advancing yarns to a waste container or the like during the bobbin changing operations.

EP 0404 045 and U.S. Pat. Nos. 5,107,668 and 5,284,010 each disclose a yarn suction apparatus of the described type which includes a yarn suction duct in which, for example, a blower generates a suction air current which flows through the duct. The duct has a plurality of inlet openings which may be closed, if need arises. A continuously advancing yarn moves along a path adjacent each opening, and the yarn is sucked into and through the inlet opening as soon as it is cut downstream of the inlet opening, i.e., between the inlet opening and the takeup device. The number of yarns which can simultaneously be carried away through the duct depends on the suction capacity and the velocity of the air current generated in the duct.

Modern yarn winding machine are designed to achieve yarn speeds of 1000 m/min and higher, and it is the object of the present invention to eliminate the relationship between the velocity of the suction air current in the suction duct and the yarn speed, and to make it possible that, when the machine is serviced by several persons or by an automatic device, the largest possible number of yarns may be reliably caught and simultaneously removed despite a high yarn speed and with little expenditure as regards the suction capacity.

SUMMARY OF THE INVENTION

The above and other objects and advantages of the present invention are achieved in the embodiments illustrated herein by the provision of an apparatus which comprises a tubular duct having one end adapted for connection to a suction generator so as to induce a suction air current through the duct, and a plurality of yarn intake tubes communicating with the tubular duct in a longitudinally spaced apart arrangement and extending outwardly therefrom, and so that a yarn is adapted to be sucked into and through each of the yarn intake tubes and into the tubular duct by the induced suction air current.

The apparatus as described above has the advantage that the flow and the pressure conditions in the suction duct are no longer exclusively decisive for the suction effect at the inlet openings of the yarn intake tubes. Rather, the effects of suction and advance operative on the yarn at the inlet openings develop with a good utilization of the suction capacity of the blower. For example, it is possible, without adversely affecting the suction effect, to have several of the yarn intake tubes open. Immediately after the yarn is caught, the yarn is engaged with a significant tension so that the risk of slacking yarn and the formation of laps is effectively avoided. The air current in the suction duct itself only has the effect of carrying away the yarns or a yarn tangle, although it is possible, though not necessary, to exert a tension on the yarn in the duct.

Accordingly, the present invention makes it possible to advance the yarn in the suction duct as a yarn tangle at a slow speed, while still exerting a sufficiently high tension on the yarn which is pulled in through the yarn intake tube.

To avoid an aerodynamic stagnation of air at the outlet opening of the yarn intake tube into the suction duct, the yarn intake tube is preferably inclined, at least in the region of its opening into the suction channel, with respect to the axis of the suction duct such that the yarn has a component of movement in the direction of the suction air current.

In its interior, each yarn intake tube may be constructed as a straight cylinder. However, it is also possible to curve each yarn intake tube continuously or sharply along its axis from the region of its outlet opening toward its intake opening. This allows the yarn to advance in the center of the intake current which develops in the yarn intake tube, and so as to exert a higher tension on the yarn. Each yarn intake tube can be connected with a closing means so as to avoid pressure losses in the suction air current, while "idling", i.e., when no yarn needs to be sucked in. As a result of the relatively low velocity of flow in the suction duct as well as the narrow dimensioning of the yarn intake tubes, these pressure losses are in any event small, since the suction duct is made with a diameter which is a multiple of that of each yarn intake tube. Even when a plurality of yarns are being removed by suction at the same time, it is possible to keep the pressure losses low, so that it is necessary to enlarge the duct cross section in steps or gradually. In this regard, it is significant that the individual currents which are sucked in through the yarn intake tubes, contain only small amounts of air, so that even when the individual currents are added up, only a relatively small increase in the total volume flow will result in the suction duct.

BRIEF DESCRIPTION OF THE DRAWINGS

Some of the objects and advantages of the present invention having been stated, others will appear as the description proceeds, when considered in conjunction with the accompanying drawings in which.

DETAILED DESCRIPTION OF THE PREFERRED EMBODIMENTS

Figure 1:
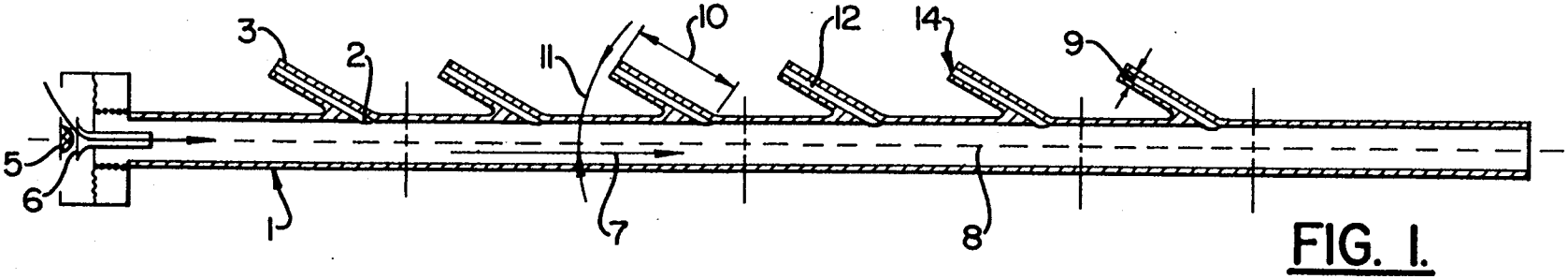
FIG. 1 is a longitudinal sectional view of a yarn withdrawal duct which embodies the features of the present invention.

Referring more particularly to the drawings, FIG. 1 illustrates a yarn withdrawal apparatus which embodies the present invention, and which comprises a tubular suction duct 1. As illustrated schematically in FIG. 2, the duct 1 is adapted to extend longitudinally along the length of a yarn winding machine which is composed of a plurality of side by side winding stations, and so that the duct 1 is adjacent and extends horizontally across each of the winding stations.

In the embodiment of FIG. 1, the tubular duct 1 is cylindrical, and it has an inside diameter of, for example, 40 mm. At its other end, the duct 1 is connected to a waste container. The waste container is in turn connected to a vacuum blower which acts to generate a vacuum of, for example, 0.7 bar. The suction duct 1 is provided along a surface line with a plurality of yarn intake tubes 3, and each intake tube 3 is joined in an airtight manner to the wall of the duct 1 in a longitudinally spaced apart arrangement. The axis of each yarn intake tube 3 is inclined with respect to the axis of suction duct 1, such that a yarn advancing through a yarn intake tube 3 has a component of movement in the direction of the suction air current 7 which is generated in suction duct 1.

Each yarn intake tube 3 is constructed as a straight or linear cylinder, and it has a constant diameter along its length. Also, the inside diameter of each of the yarn intake tubes is typically between about ¼ and 1/25 of the inside diameter of the tubular duct 1, and the length of each of the yarn intake tubes 3 is typically between about 50 and 250 mm. As a specific example, the inside diameter of the duct 1 is about 40 mm, each yarn intake tube measures about 100 mm in length and its inside diameter is about 5 mm.

In the embodiment of FIG. 1, an auxiliary closing valve 5, 6 is mounted at the end of the duct 1 opposite the connection to the waste container, and the auxiliary valve 5, 6 enables the inflow of additional air into the duct 1, when it is found that the air quantity entering through the yarn intake tubes 3 does not suffice for a reliable transport of the yarn in the duct 1.

Figure 3:
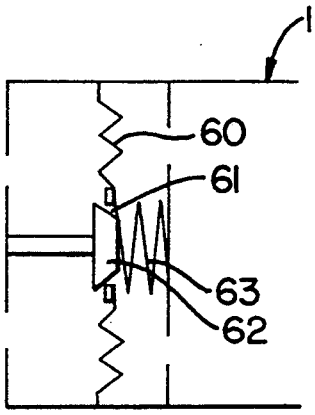
FIG. 3 is an enlarged view of one of the ends of the yarn withdrawal duct and illustrating another embodiment of the valve device for selectively opening the free end of the duct to the atmosphere.

FIG. 3 illustrates an alternative embodiment for the valve 5, 6, and in this embodiment, the valve body is attached to a pressure biased diaphragm 60. More particularly, the end of the duct 1 is closed by the diaphragm 60, and the diaphragm 60 is provided with an inlet opening 61 at its center. The inlet opening 61 is closed by a valve cone 62 which is fixedly mounted to the suction duct 1. In its non-operative condition, the diaphragm 60 is biased by a spring 63 in the direction of closing, so that the opening 61 is substantially or entirely closed. When for example only a single yarn is being sucked into the duct 1, the suction blower produces a strong vacuum in the duct 1, and as a result, the diaphragm of the valve 5 is biased via the pressure differential between the outside atmospheric pressure and the reduced pressure in the duct 1 against the force exerted by the spring 63. This in turn causes the valve 5 to open. When two or more yarns are being sucked into the duct 1, the partial vacuum in the duct 1 is accordingly smaller, and thus also the deflection of the diaphragm 60 is reduced and the opening width of the valve 5 becomes smaller.

As a result of the above construction, it may be insured that a yarn which advances in front of the opening of each yarn intake tube 3 can be removed at a high speed and a high yarn tension. With the slower suction air current in the tube 1, the yarn then may form a yarn snarl, tangle, or plug, which is delivered by the suction air current into the waste container.

In operation, the partial vacuum which is generated by the vacuum pump acts to generate in suction duct 1 a suction air current in direction of arrow 7. As a result, an air current is induced in each intake tube 3. This air current is, in accordance with the diameter ratio, substantially greater in velocity than the air current in suction duct 1. In accordance with the invention, the narrow diameter of intake tube 3 is adapted to the larger diameter of suction duct 1 such that a large pressure difference develops over the length of each intake tube 3. As a result, high velocities of flow develop at the entry opening of each yarn intake tube. This high velocity of flow results in the yarn being reliably caught after its cutting, and a sufficient yarn tension is developed so that the yarn is advanced through the passageway of the yarn intake tube and into the suction duct 1.

Figure 2:
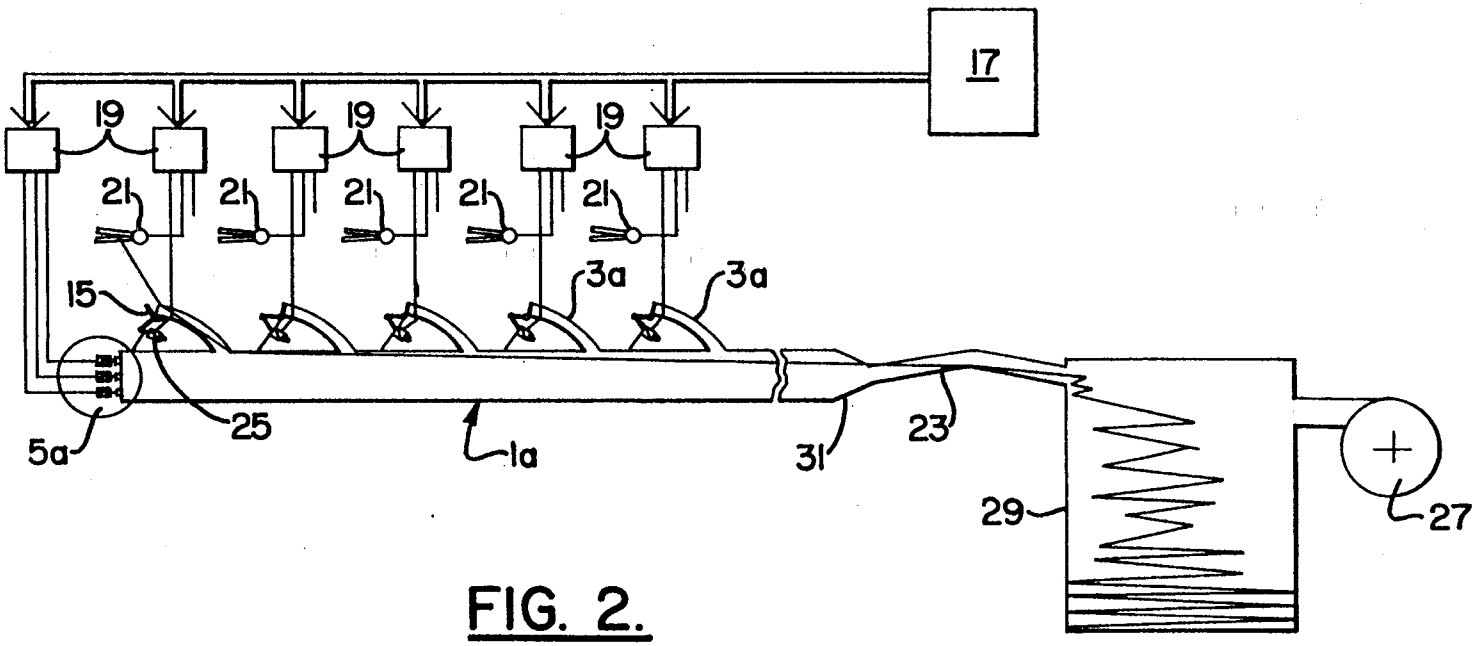
FIG. 2 is a schematic illustration of a yarn winding machine, and which includes a further embodiment of the yarn withdrawal duct of the present invention.

A further embodiment of the invention is illustrated in FIG. 2, which schematically illustrates portions of several of the side by side winding stations of a yarn winding machine, and which specifically illustrates a further embodiment of a suction duct la which extends horizontally across the winding stations. In this embodiment, the yarn intake tubes **3*a*** are curved approximately in their central region. Other intake tubes which may alternatively be used, are curved over their entire length. The angle of the curvature is selected such that a yarn advancing over the length of the intake tube is deflected by the curvature only insignificantly, and preferably not all.

Figure 2A:
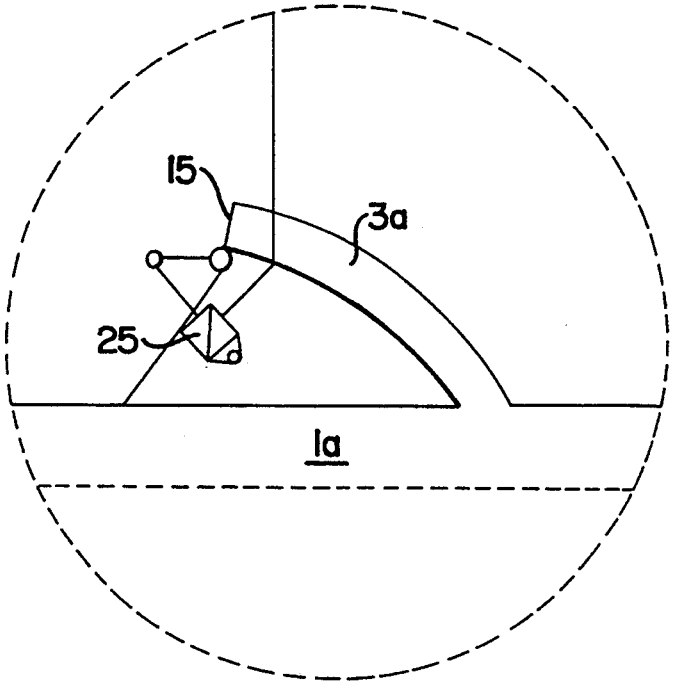
FIG. 2A is an enlarged fragmentary view showing one of the yarn intake tubes of the embodiment illustrated in FIG. 2.

As best seen in FIG. 2A, each yarn intake tube **3*a* can be selectively opened and closed by a valve 15. A magnet 25 serves to actuate the valve. The magnet 25 is activated by a machine control system 17 and a position control system 19. The control system 19 is synchronized with a control for a yarn cutter 21, which cuts the yarn upon completion of a winding cycle. The magnet 25 is again activated in the sense of closing, after the yarn has again been threaded on the bobbin at the beginning of a winding cycle and cut between the bobbin and the duct 1*a***.

The duct la terminates in a so-called "high-speed zone" 23. The latter is a tube which has a smaller diameter and is connected in an airtight manner to the suction duct **1*a* by means of a funnel-like reducer tube 31. The high-speed zone 23 is connected to a waste container 29, which serves to collect the waste yarn. The container 29 is in turn connected to a suction blower 27 which produces a vacuum and a suction air current in the waste container and, thus, likewise in the high-speed zone 23, the suction duct 1*a*, and the intake tubes 3*a*. Provided at the other end of suction channel 1*a* is an auxiliary valve 5*a* which may be adjusted in the same manner as in FIG. 1. The valve 5*a*** comprises three additional inlet openings which can be opened and closed independently of one another.

In operation, the suction blower 27 generates a vacuum in waste container 29, which is hermetically sealed. As a result, air is sucked in via the high-speed zone 23, the suction duct **1*a*, as well as the intake tubes 3*a* (to the extent they are open). This produces initially a pressure gradient in the high-speed zone 23, since the latter has a reduced cross section with respect to that of the suction duct 1*a*. This pressure gradient converts itself to a corresponding speed increase. Furthermore, a pressure gradient forms inside each of the intake tubes 3, and this pressure gradient also causes a corresponding increase in velocity of the air current. The yarn which is sucked into the respective intake tube, is thus immediately engaged by an air current at a high velocity and reliably advanced into the suction duct. There, the yarn is advanced together with other yarn material, at first at a relatively low air velocity, to the high-speed zone 23**, where it is again withdrawn by the faster air current.

Subsequently, the yarn enters into the waste container, where it drops to the bottom. Thus, each yarn taken in by suction is subjected to a high-velocity air current, first in the yarn intake tube and then in the high-speed zone 23, and as a result a yarn tension builds up in two steps. In this process, each yarn reaches, due to the curvature of intake tube 3 not only the marginal zone of the air current, but also the central regions of the air current. This has the advantage that, in contrast to the marginal zones, the central regions of the air current have a high velocity.

Likewise, the curvature of the high-speed zone 23 as illustrated in FIG. 2 serves the purpose of advancing the yarn at least over certain lengths in the central region of the air current.

During the operation of the respective yarn winding station, the yarn intake tube 3 associated thereto is closed by valve 15. When a package is fully wound, the yarn cutter 21 is actuated, which is arranged between the intake tube and the package. As this yarn cutter is actuated, the magnet 25 of valve 15 is actuated at the same time, and the valve opens. As a result, the yarn advancing in front of the inlet opening of yarn intake tube is grasped by the suction current and pulled into the intake tube.

To obtain in the suction duct 1*a*, and in particular in the high-speed zone 23, a sufficiently strong suction current, a certain quantity of air is necessary. This quantity of air is automatically made available, when several winding positions are serviced at the same time, i.e., several intake tubes are opened. For example, it may be assumed that four intake tubes must always be open at the same time. When this condition is not met, it is possible, for purposes of supplementing the air current, to open a number of auxiliary valves 5*a*, so that always four openings are available for the inflow of air. Thus, when only one yarn needs to be removed by suction, all three auxiliary valves 5*a* will be opened. When three yarns are sucked off, only one of the auxiliary valves 5*a* will have to be open.

Figure 4:
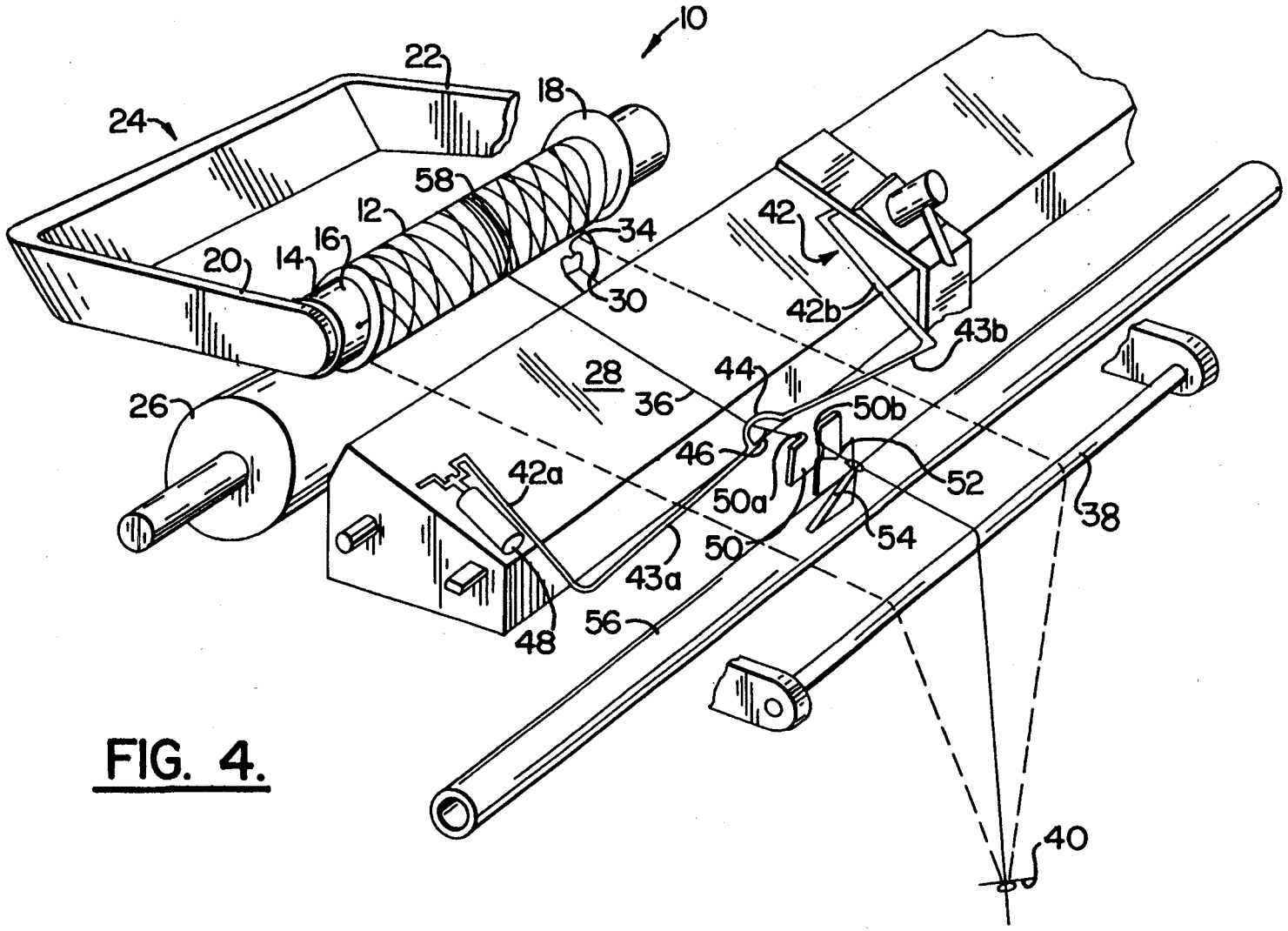
FIG. 4 is a perspective view of a yarn winding station of the yarn winding machine, and which embodies the features of the present invention.

FIG. 4 illustrates a winding station in which the suction system of the present invention is used. This winding station is further illustrated in German application, serial number P 42 12 241.4, which was filed in Germany on Apr. 11, 1992, and in U.S. application Ser. No. 08/046,014, filed concurrently herewith, the disclosures of which are expressly incorporated herein by reference.

In the embodiment of FIG. 4, the yarn winding apparatus comprises a tubular yarn bobbin 14 having a yarn wound there upon to form a cross wound package 12. A bobbin 14 is rotatably supported between centering plates 16 and 18 on the opposite arms 20 and 22 of a conventional mounting bracket 24, which forms a part of the textile winding machine, which is not further shown. The bobbin 14, or the cross wound package 12 formed thereon, rests on a friction drive roll 26. The roll 26 is rotated by a conventional drive (not shown) and thereby rotates the bobbin 14 and the package 12 being formed thereon.

Located in front of the friction drive roll 26 is a housing 28 which is provided with a slot, which is not visible in the drawing. From this slot a yarn traverse guide 30 projects, and the guide 30 is reciprocated by a cross spiraled roll located in the housing 28, but not shown, along a lateral direction which is parallel to the rotational axis of the bobbin 14. The yarn traverse guide 30 is provided with an upwardly open slot 34, which serves to guide an advancing yarn 36 which is pulled by the package 12 under a certain tension over a yarn guide rod 38 and through a preceding, fixed yarn guide 40, such as an eyelet. As a result of the reciprocating motion of the yarn traverse guide 30, the yarn 36 defines a traversing triangle, which in the drawing is shown bent over the yarn guide rod 38. The lateral extent of the triangle is shown by dashed lines.

In the direction of the advancing yarn, and preceding the yarn traverse guide 30, a yarn lifting member 42 is positioned, which is in the drawing shown as a U-shaped bracket, whose legs 42*a* and 42*b* are parallel to each other and pivotally supported at their inner ends on the housing 28 so as to pivot about a lateral axis which is parallel to the rotational axis of the bobbin 14 and package 12. At their outer ends, the legs 42*a* and 42*b* are interconnected to a laterally directed slide rod which extends between the outer ends of the legs 42*a* and 42*b*. The slide rod comprises two laterally directed arms 43*a* and 43*b* which are inclined with respect to each other so as to have the configuration of a shallow V. A U-shaped yarn catch 44 is joined between the adjacent ends of the arm 43*a* and 43*b*, and so as to be located at a medial location along the length of the slide rod. The yarn catch 44 further includes an extension or yarn retainer 46 which projects from arm 43*a* and is directed toward arm 43*b*, and extends across the open end of the U.

The leg 42*a* of the bracket 42 is connected with an actuator 48, which comprises for example an electromagnet or a double acting piston-cylinder unit. This actuator causes the bracket 42 to pivot between its lowered idle position as shown in FIG. 4 and a lifted position (not shown) which constitutes a rotational distance of about 90 degrees. In the illustrated position, the bracket 42 lies below the yarn 36, i.e., below the traversing plane.

Arranged in the direction of the advancing yarn and upstream of the lifting member 42 is a cutter 50, which has an obliquely upwardly directed cutting blade 50*a*, which faces a likewise obliquely upward directed guide edge 50*b*. The cutting blade 50*a* and the guide edge 50*b* form between them an upwardly open V-shaped slot. The opening of the slot lies below the traversing plane. Located in front of the cutter 50 and the guide edge 50*b* is a yarn centering device 52 whose upper edge is also in the form of a V-shape slot.

Located in front of the yarn centering device 52 is a yarn intake tube 54 which is connected to a horizontally extending suction duct 56.

Upon the cross wound package 12 reaching a predetermined diameter, the machine control releases a signal indicating the end of the winding cycle. This signal is transmitted to the actuator 48 of bracket 42, and the actuator 48 moves in the sense of pivoting bracket 42 to its upright position. In so doing it lifts the yarn 36 out of the slot 34 of traversing yarn guide 30. Due to its tension and the inclination of arms 43*a* and 43*b*, the yarn 36 slides along the underlying arm 44*a* or 43*b*, if need be, along the extension 46, and through the gap into catch 44. In so doing, it slides below the extension 46. However, since the package continues to rotate, the yarn 36 is guided to a point on the circumference of package 14, which lies substantially in the same vertical plane as the catch 44, centering device 52, and stationary yarn guide 40. Thus, the package 12 receives a final wind 58 consisting of several yarn windings. Upon expiration of a time interval corresponding to the number of desired yarn windings, the actuator 48 is reactivated, this time in the sense of returning bracket 42 to its position below the traversing triangle. At the same time, the magnetic valve 15 (FIGS. 2 and 2A) associated with the winding station opens.

During this pivotal movement, the yarn 36 is held by extension 46, guided against cutting blade 50*a*, and cut on same, i.e., the yarn 36 is guided substantially in the aforementioned vertical plane. The bracket 42 and its actuator 48 are therefore identical in function with the yarn cutter 21 of FIG. 2, which is shown only schematically. At the same time as the yarn 36 is cut, its end advancing from stationary yarn guide 40 is guided in front of the yarn intake tube 54 of the suction duct 56, grasped by the suction current, and advanced into the waste container (see FIG. 2). The other end of yarn 36 is taken up in the final wind 58. Subsequently, the package can be removed from mounting support 24 by releasing the centering plates in known manner, and replaced with an empty tube.

The apparatus of the present invention is also suitable to produce yarn packages without a final wind, which may be desired under certain conditions. To this end, it is necessary to raise bracket 42 only so much that the yarn 36 engages in the catch 44 of bracket 42, and as the latter is pivoted back to its lower position, it is guided for purposes of cutting into cutter 50 and in front of the opening of intake tube 54.

The yarn then advances into the suction duct 56, and it is possible to thereafter remove the full package from the package holder and to insert an empty bobbin. Subsequently, an arm reaches into the path of the yarn advancing to the intake tube and pulls the yarn out to form a loop. One end of the loop is then placed on the rotating empty bobbin, and the winding operation commences in accordance with well known procedures.

In the drawings and specification, there has been set forth a preferred embodiment of the invention, and although specific terms are employed, they are used in a generic and descriptive sense only and not for purposes of limitation.

That which is claimed is:

1. An apparatus for withdrawing one or more advancing yarns to a waste container comprising a tubular duct having one end adapted for connection to a suction generator so as to induce a suction air current through said duct, a plurality of yarn intake tubes communicating with said tubular duct in a longitudinally spaced apart arrangement and extending outwardly therefrom, and so that a yarn is adapted to be sucked into and through each of said yarn intake tubes and into said tubular duct by the induced suction air current, and said one end of said tubular duct including a tubular portion of reduced diameter connected to said tubular duct by a funnel-like reducer tube so as to induce a high speed air current in a central region through said tubular portion, and wherein said tubular portion of reduced diameter has a curvature along its length which is configured to cause the yarn to advance in the central region of the tubular portion along at least a substantial portion of the length of said tubular portion.

2. The apparatus as defined in claim 1 wherein said portion of reduced diameter is between one third and two thirds of the diameter of said tubular duct.

3. The apparatus as defined in claim 1 wherein each of said yarn intake tubes is non-linear and has a constant diameter along its length.

4. The apparatus as defined in claim 1 wherein said tubular duct defines a longitudinal axis, and wherein each of said plurality of yarn intake tubes is disposed at an incline with respect to said axis of said duct and so that a yarn advancing through any one of said yarn intake tubes has a component of movement in the direction of said axis and toward said one end.

5. The apparatus as defined in claim 1 wherein said curvature of said tubular portion is configured to permit the yarn to advance therethrough along an essentially linear path.

6. A yarn winding machine comprising a plurality of side by side yarn winding stations, with each of said yarn winding stations comprising (a) means for rotatably mounting a tubular yarn bobbin, (b) drive means for rotating a yarn bobbin mounted on said bobbin mounting means, (c) yarn traversing means for engaging and reciprocating a yarn advancing along a path of travel to the rotating yarn bobbin and so as to form a cross wound package on the rotating yarn bobbin, (d) yarn cutting means mounted along the path of travel, and suction means mounted adjacent said yarn cutting means for withdrawing the advancing yarn at each of said yarn winding stations upon the cutting of the yarn by the associated yarn cutting means, said suction means comprising (a) a tubular duct extending longitudinally along the yarn winding machine and adjacent each of said winding stations, said tubular duct having one end and an opposite end, (b) a waste container connected to said one end of said tubular duct, and a suction generator connected to said waste container so as to induce a suction air current through said tubular duct and into said waste container, (c) a plurality of yarn intake tubes communicating with said tubular duct in a longitudinally spaced apart arrangement and extending outwardly therefrom, with said yarn intake tubes being aligned with respective ones of said winding stations and so that upon being cut by the associated yarn cutting means, the yarn is adapted to be sucked into and through the associated yarn intake tube and into said tubular duct and then into said waste container by the induced suction air current, and said one end of said tubular duct including a tubular portion of reduced diameter connected to said tubular duct by a funnel-like reducer tube so as to induce a high speed air current in a central region through said tubular portion, and wherein said tubular portion of reduced diameter has a curvature along its length which is configured to cause the yarn to advance in the central region of the tubular portion along at least a substantial portion of the length of said tubular portion.

7. The apparatus as defined in claim 6 wherein said portion of reduced diameter is between one third and two thirds of the diameter of said tubular duct.

8. The apparatus as defined in claim 6 wherein each of said yarn intake tubes is non-linear and has a constant diameter along its length.

9. The apparatus as defined in claim 6 wherein said tubular duct defines a longitudinal axis, and wherein each of said plurality of yarn intake tubes is disposed at an incline with respect to said axis of said duct and so that a yarn advancing through any one of said yarn intake tubes has a component of movement in the direction of said axis and toward said one end.

10. The apparatus as defined in claim 6 wherein said curvature of said tubular portion is configured to permit the yarn to advance therethrough along an essentially linear path.

11. The apparatus as defined in claim 6 further comprising auxiliary valve means for selectively opening and closing said opposite end of said tubular duct to enable the inflow of additional air into said tubular duct.

12. The apparatus as defined in claim 6 further comprising means for selectively closing each of said yarn intake tubes so as to preclude the passage of air thereunto.

* * * * *